US005307931A

United States Patent [19]

Gillispie et al.

[11] Patent Number: 5,307,931

[45] Date of Patent: May 3, 1994

[54] HAZARDOUS MATERIAL SPILL SKID

[75] Inventors: John G. Gillispie; Donald J. Mitchell, both of Wellsburg, W. Va.

[73] Assignee: Eagle Manufacturing Co., Wellsburg, W. Va.

[21] Appl. No.: 72,268

[22] Filed: Jun. 3, 1993

[51] Int. Cl.[5] ..... B65D 19/18

[52] U.S. Cl. ..... 206/386; 108/51.1; 108/56.3; 108/901; 206/600

[58] Field of Search ..... 206/386, 599, 600; 108/51.1, 53.1, 55.1, 53.3, 56.3, 901

[56] References Cited

U.S. PATENT DOCUMENTS

| | | | |
|---|---|---|---|
| 3,638,586 | 2/1972 | Elshout | 108/51.1 |
| 3,759,194 | 9/1973 | Fujii et al. | 108/901 X |
| 3,878,796 | 4/1975 | Morrison | 108/901 X |
| 3,995,749 | 12/1976 | Haskins | 206/599 |
| 4,133,270 | 1/1979 | Ravera | 108/51.1 |
| 4,183,491 | 1/1980 | Sanders et al. | 108/51.1 X |
| 4,263,855 | 4/1981 | Lawlor | 108/53.3 |
| 4,674,414 | 6/1987 | Nülle et al. | 108/53.3 |
| 4,838,178 | 6/1989 | Chriske et al. . | |
| 4,930,632 | 6/1990 | Eckert et al. . | |
| 5,020,667 | 6/1991 | Bush . | |
| 5,036,976 | 8/1991 | Sechler et al. . | |
| 5,082,124 | 1/1992 | Bonvini et al. | 108/901 X |
| 5,092,251 | 3/1992 | Hamaker et al. . | |
| 5,144,897 | 9/1992 | Avery | 108/55.3 |
| 5,147,039 | 9/1992 | Sechler et al. . | |

FOREIGN PATENT DOCUMENTS

| | | | |
|---|---|---|---|
| 2918573 | 11/1980 | Fed. Rep. of Germany | 206/599 |

*Primary Examiner*—Bryon P. Gehman

*Attorney, Agent, or Firm*—Armstrong, Westerman, Hattori, McLeland & Naughton

[57] ABSTRACT

A hazardous material spill skid has a tray and a pair of interchangeable grate members for support of industrial drums. The tray has a bottom and upwardly and outwardly extending walls that terminate as horizontal flanges with an outer rim and inward lips. A hollow center post is provided with four arms, one of which extends towards each corner of the tray. A pair of blow molded, hollow, interchangeable grate members rest on the horizontal flanges of the side and end walls of the tray and directly on two of the arms of the center post to provided support for the grate member and drums placed thereon.

19 Claims, 4 Drawing Sheets

HAZARDOUS MATERIAL SPILL SKID

FIELD OF THE INVENTION

The present invention relates to a hazardous material spill skid and comprises a containment tray for containment of spillage from industrial drums and a support grating supported on the containment tray providing a stable surface for industrial drums.

BACKGROUND OF THE INVENTION

With the ever increasing stringent regulations relative to hazardous materials, users of such materials as organic solvents are required to contain any spillage or leakage from industrial drums and prevent pollution of underlying substrates and runoff of such materials to soil or water courses.

Examples of hazardous waste spill skids of the prior art are described in U.S. Pat. No. 4,838,178, U.S. Pat. No. 4,930,632, U.S. Pat. No. 5,020,667, U.S. Pat. No. 5,036,976, U.S. Pat. No. 5,092,251 and U.S. Pat. No. 5,147,039. In U.S. Pat. No. 4,838,178, a hazardous waste shipping pallet is shown which is preferably formed as a metal tray with a plywood platform. The shipping pallet has a planar base and a rigid support member fixedly mounted to the bottom surface of a container, and at least one internal load bearing rail fixedly mounted to the uppermost surface of the inside of the container, with a removable platform positioned on the load bearing rail. U.S. Pat. No. 4,930,632 shows a tray having a base and substantially vertical side walls to form a containment pan with the side wall upper edges lying in a common plane, the tray bottom wall having grooves to receive forks of a fork lift and reinforcement ribs between the grooves. A pallet support member rests in the tray and is formed of spaced apart beams and transverse rails attached to the beams to form a platform to support a storage pallet above the plane formed by the upper edges of the tray side walls. In U.S. Pat. No. 5,020,667, a rectangular chamber is formed by a polyethylene bottom and side walls, the side walls having a support ledge at the upper periphery thereof. A fiberglass grating is provided that has spaced bars shaped to direct spilled material into the chamber, and a polyvinyl or polyethylene support tube, preferably removable, is disposed in a central chamber of the rectangular chamber, with apertures in the tube to allow dispersal of spillage to other subchambers. U.S. Pat. No. 5,036,976, which is a continuation of the application which issued as U.S. Pat. No. 4,930,632 has a tray similar to the tray of that earlier patent and a pallet support member which rests in the tray, the pallet support member comprising at least one support member received within the tray and resting on the bottom wall and a platform member supported by the support member to form a platform substantially at the level of the plane formed by the tray side wall upper edges, so as to provide support for a storage pallet adjacent to or above that plane. In U.S. Pat. No. 5,092,667, a rotationally molded integral pallet and platform are described, with a basin beneath the platform, the platform having an undulating cross-section and a plurality of holes passing through the platform to permit leakage from drums supported on the platform to enter the basin. A center post may extend from the bottom wall of the base of the basin to a position adjacent the platform to support the platform at the center thereof. U.S. Pat. No. 5,147,039, which is a continuation of the application from which U.S. Pat. No. 5,036,976 issued, shows a containment tray having a floor and vertical side walls and a removable support structure insertable into the tray and resting on the floor, the removable support comprising a plurality of upright support members resting on the floor and a plurality of members positioned on the support members to form a generally horizontal support platform on which a palletized load of containers may be positioned.

Applicants are also aware of a spill pallet available commercially which has a polyethylene tray with four walls and a central support extending between two opposed walls of the tray and central extensions extending from the central support in the direction of the other two walls. The central support has an upward ridge therealong which divides the tray into two sections, with a solid grate resting in each of the two sections of the unit, on a wall ledge and on the central support, adjacent the upward ridge, and on one of the central extensions.

SUMMARY OF THE INVENTION

A hazardous material spill skid comprises a rectangular tray formed of plastic material and a pair of interchangeable grates for support of industrial drums thereon. The rectangular tray has a bottom wall and side and end walls extending upwardly and outwardly therefrom which terminate as a horizontally outwardly extending flange ending in a vertically upwardly extending rim. A hollow center post is provided in the tray that has a center portion and four arms, one arm of which extends towards each corner connection between a side wall and an end wall of the tray, the center post having an upper surface in a horizontal plane substantially the same as a horizontal plane formed by an upper surface of the outwardly extending flanges on the side and end walls of the tray. A pair of interchangeable grate members are provided, with each grate member resting on a flange of an end wall or side wall, a portion of a flange of each side wall or end wall, and on two of the arms of the center post so as to provide support for drums or barrels placed thereon. Each grate is preferably a blow molded unit which has hollow bars connected by spaced cross-bars, which extend between opposed side bars and opposed end bars forming a rectangular frame.

DETAILED DESCRIPTION

The hazardous material spill skid of the present invention is adapted to support four commercial drums and provides at least three-point support for a drum regardless of which quadrant the drum is placed on the skid grating.

Figure 1:
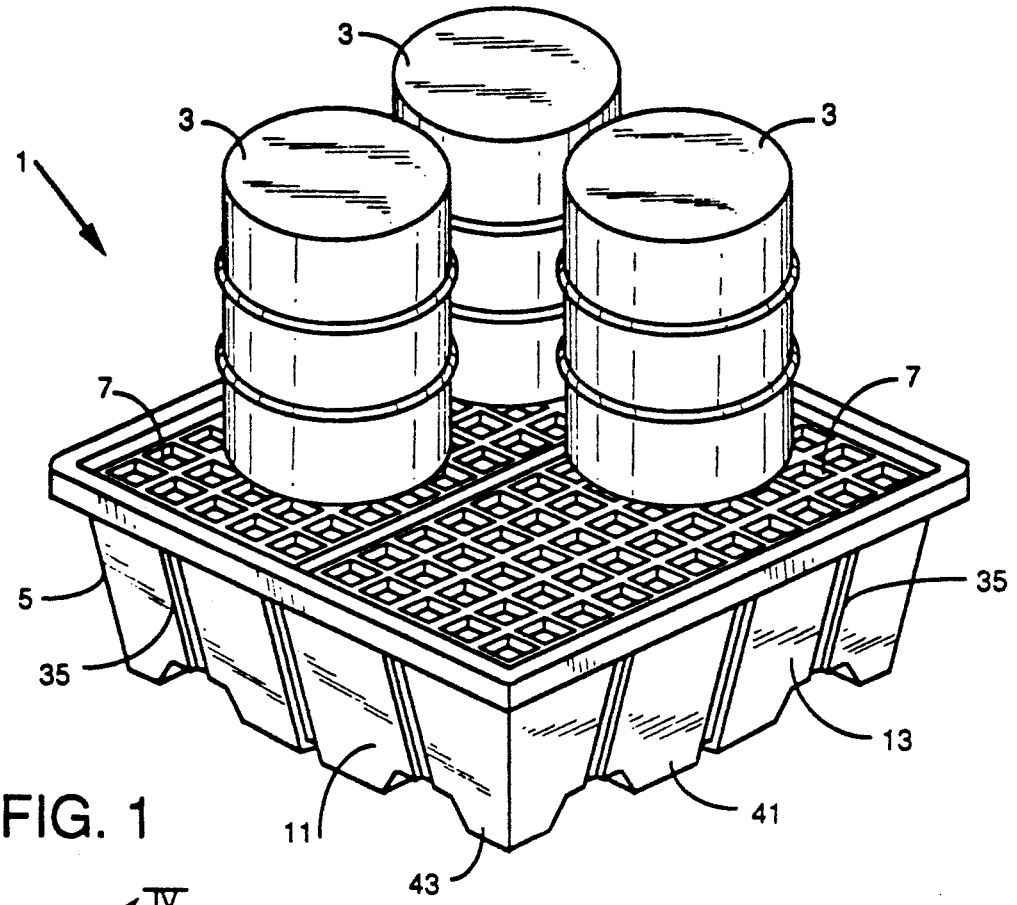
FIG. 1 is a perspective view of an embodiment of the hazardous material spill skid of the present invention showing three drums supported thereon.
Figure 2:
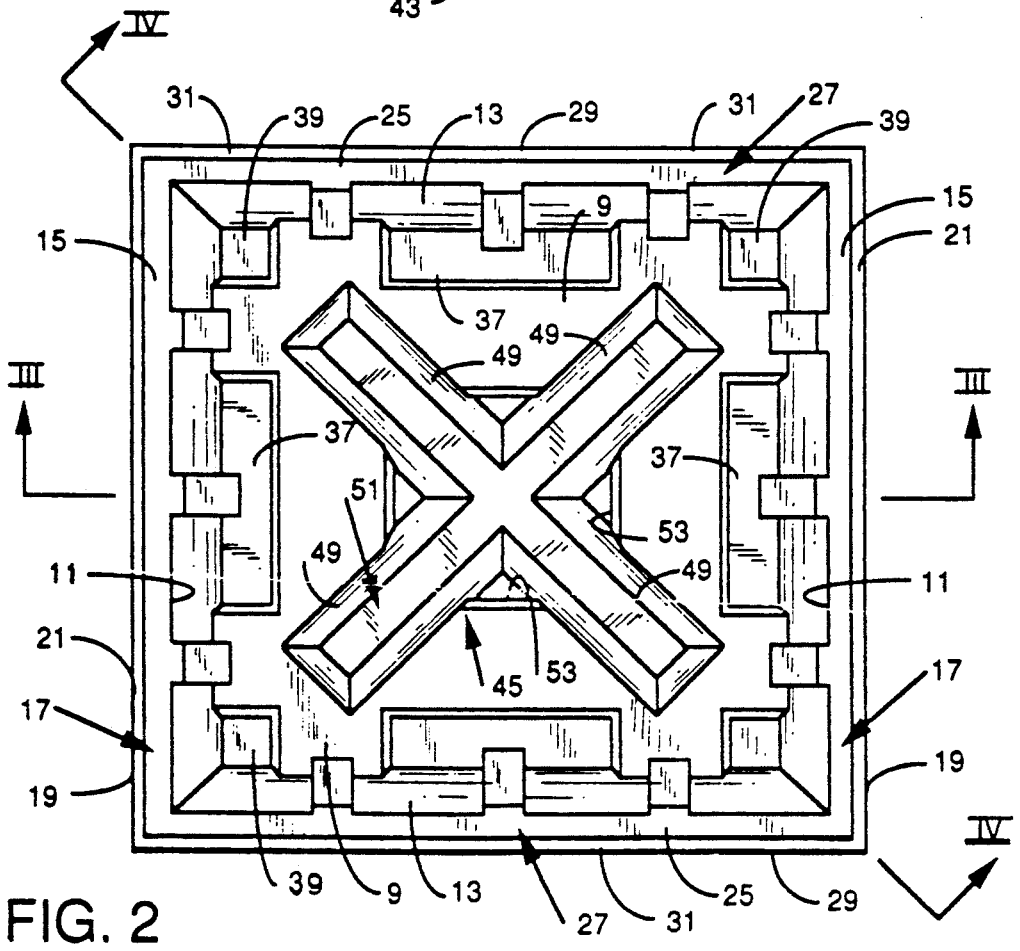
FIG. 2 is a top plan view of the rectangular tray of the hazardous material spill skid of the present invention.
Figure 3:
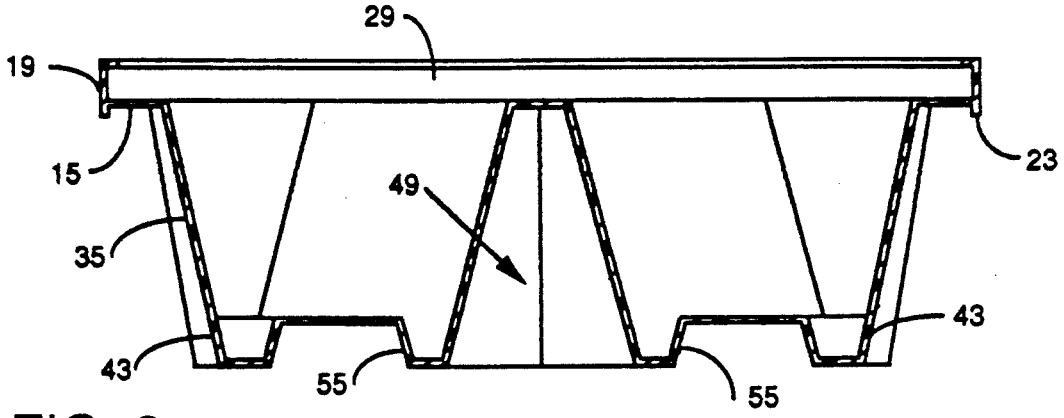
FIG. 3 is a view taken along lines III—III of FIG. 2.
Figure 4:
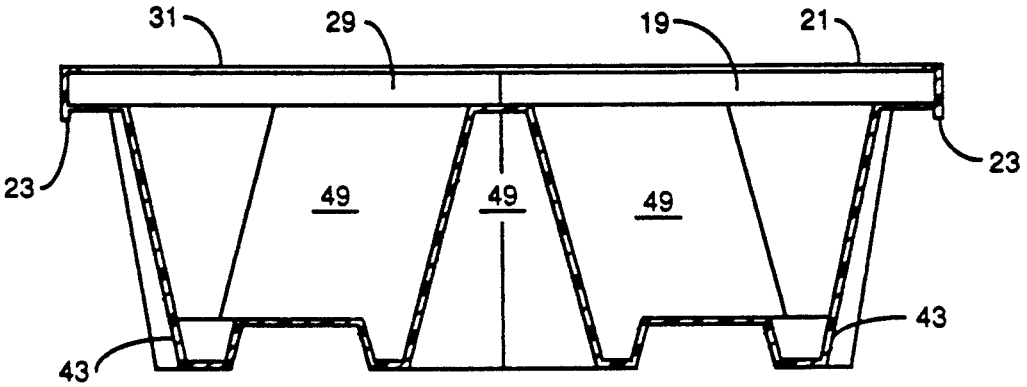
FIG. 4 is a view taken along lines IV—IV of FIG. 2.
Figure 5:
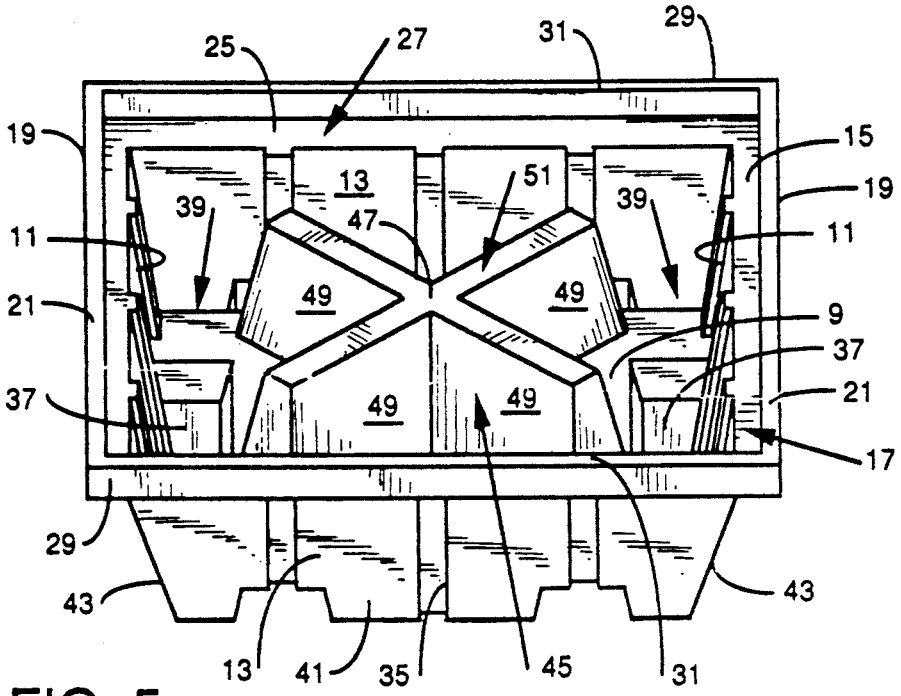
FIG. 5 is a top isometric view of the rectangular tray shown in FIG. 2.
Figure 6:
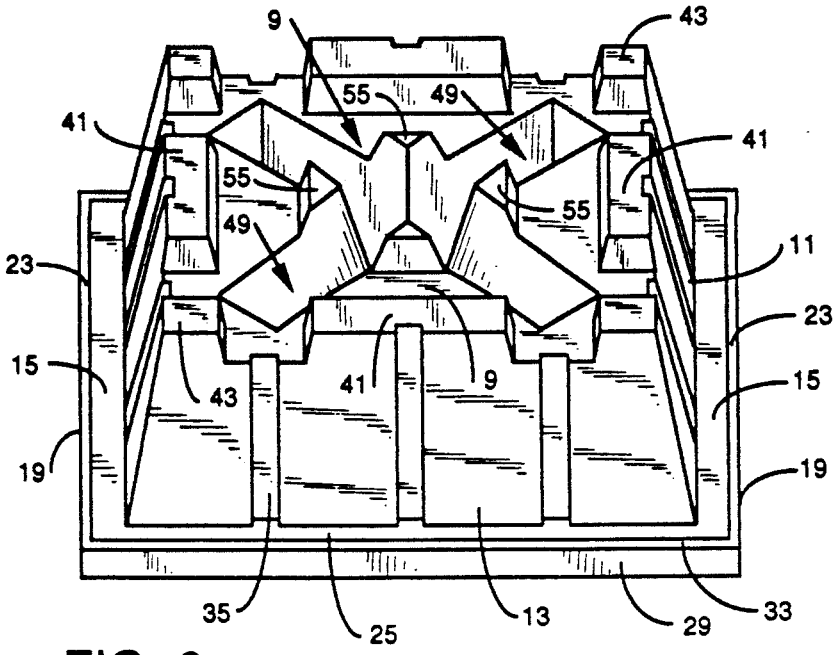
FIG. 6 is a bottom isometric view of the rectangular tray shown in FIG. 2.
Figure 7:
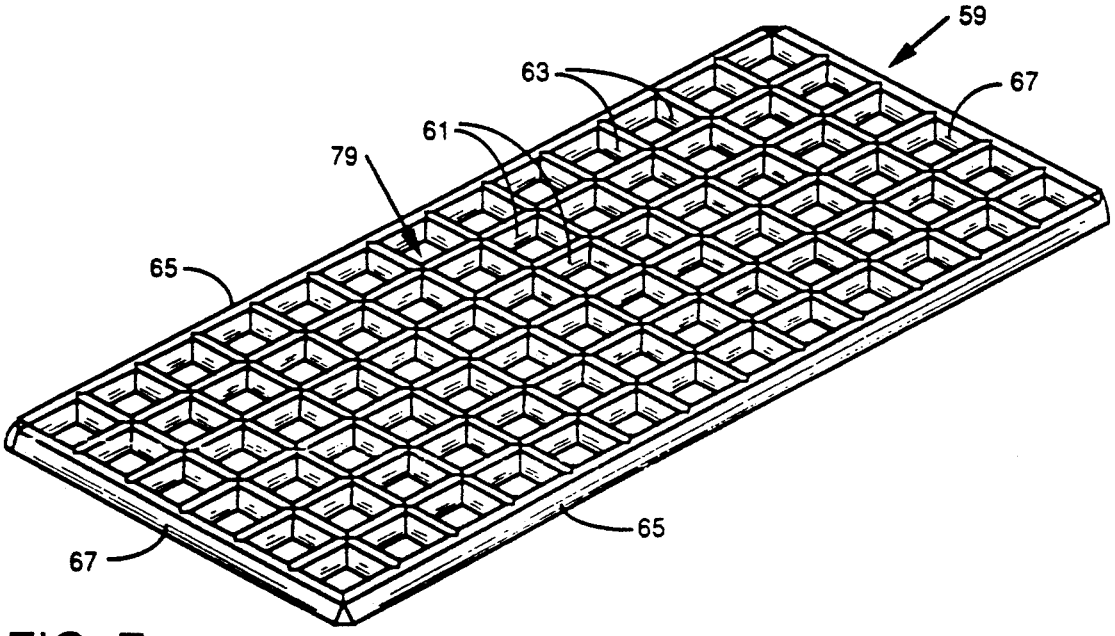
FIG. 7 is a perspective view of a grate member, one of a pair of which are used in the hazardous material spill skid of the present invention.
Figure 8:
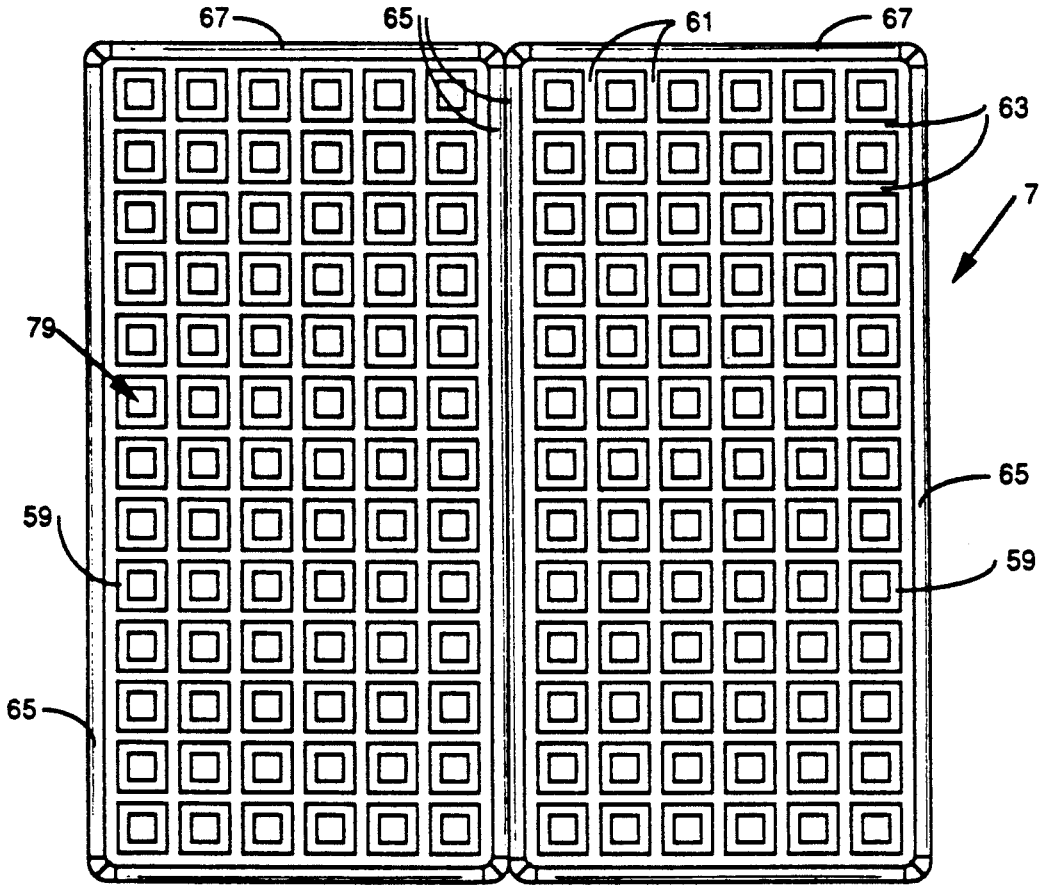
FIG. 8 is a top plan view of a pair of grates as the same would rest on the rectangular tray of the hazardous spill skid of the present invention.
Figure 9:
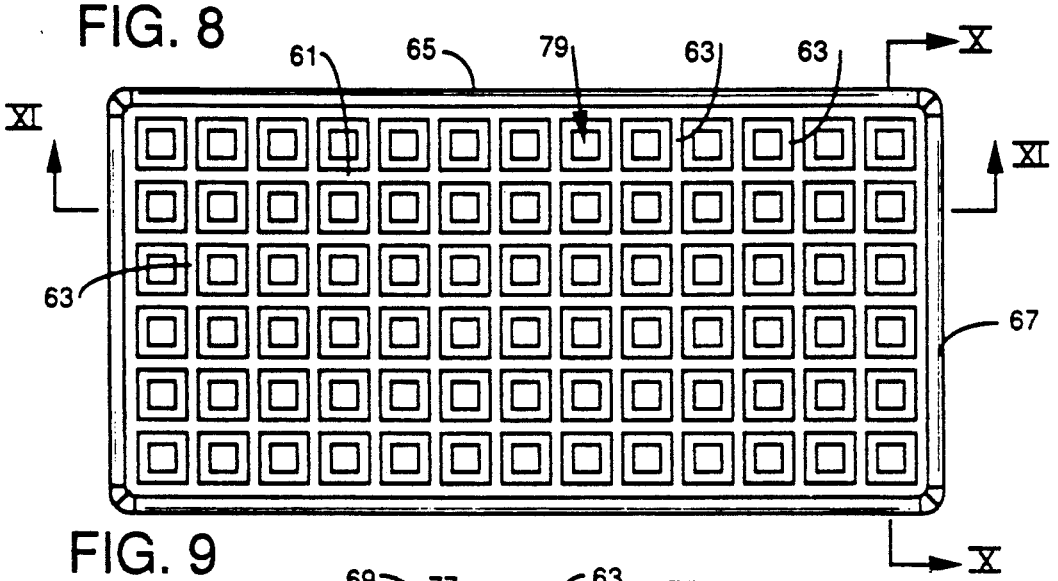
FIG. 9 is a top plan view of the grate illustrated in FIG. 7.
Figure 10:
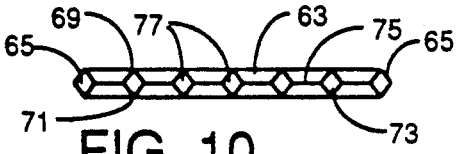
FIG. 10 is a cross-sectional view taken along lines X—X of FIG. 9.
Figure 11:
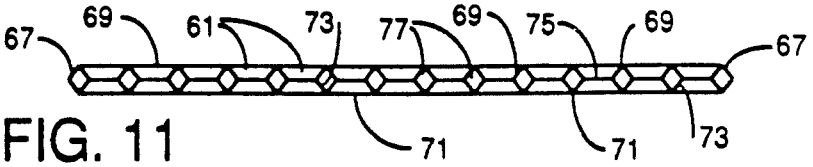
FIG. 11 is a cross-sectional view taken along lines XI—XI of FIG. 9.

Referring now to FIG. 1, a hazardous material spill skid 1 of the present invention is illustrated with three commercial drums 3 supported thereon, the hazardous material spill skid 1 comprising a rectangular tray 5 and a pair of interchangeable grates 7.

The rectangular tray 5, preferably of a square shape, as best shown in FIGS. 2–6 has a bottom wall 9, a pair of opposed side walls 11, which extend upwardly and outwardly from the bottom wall 9, and a pair of opposed end walls 13 which also extend upwardly and outwardly from the bottom wall 9. Each side wall 11 terminates in a horizontally outwardly extending flange 15, having an upper surface 17, and a vertically upwardly extending rim 19, which terminates in an inwardly directed lip 21. A downwardly depending leg 23 is provided at the outer end of the flange 15. Each end wall 13 terminates in a horizontally outwardly extending flange 25, having an upper surface 27 and a vertically upwardly extending rim 29, which terminates as an inwardly directed lip 31. A downwardly depending leg 33 is provided at the outer end of the flange 25. The upper surf aces 17 and 27 lie in a substantially horizontal plane spaced from the bottom wall 9. Vertical, inwardly extending recesses 35 are provided in each of the side walls 11 and end walls 13 to act as strengthening ribs, which recesses extend from the bottom wall 9 to the outwardly extending flanges 15 and 25, respectively. A plurality of downwardly extending recesses are formed in the bottom wall 9, shown as first downwardly extending rectangular shaped recesses 37 and second downwardly extending square shaped recesses 39. The downwardly extending first rectangular shaped recesses 37 are located adjacent the center of the side walls 11 and the end walls 13 and form intermediate legs 41 which extend downwardly from bottom wall 9 adjacent the central portion of the side and end walls 11 and 13, while the downwardly extending square shaped recesses 39 are located in the bottom wall 9 adjacent each corner formed by contiguous side walls 11 and end walls 13, to form corner legs 43 which extend downwardly from the corners of the tray 5 where a side wall 11 meets an end wall 13.

In the center of the bottom wall 9 of the tray 5 is an upwardly extending center post 45, the upwardly extending center post 45 having a central portion 47 and four arms 49, with an arm 49 extending outwardly f rom the central portion 47 towards a corner connection between a side wall 11 and an end wall 13, but terminating adjacent a downwardly extending square shaped recess 39 in the bottom wall 9. The center post 45 has an upper surface 51 that lies in a horizontal plane substantially the same as a horizontal plane formed by the upper surface 17 and 27 of the horizontally outwardly extending flanges 15 and 25 on the side walls 11 and end walls 13 of the rectangular tray 5. At the intersection of adjacent arms 49 of the upwardly extending center post 47, central downwardly extending triangular shaped recesses 53 are provided in the bottom wall 9 which form four central support legs 55. As best seen by reference to FIG. 6, fork lift channels 57 are provided between the triangular shaped central support legs 55 on one side and intermediate legs 41 and corner legs 43 on the other side.

The grate 7 that is used in the hazardous material spill skid 1 of the present invention is comprised of a pair of grate members 59 which are interchangeable on the rectangular tray 5. Referring now to FIGS. 7–11, the grate members 59 are illustrated and comprise a plurality of spaced parallel bars 61 interconnected by a plurality of spaced cross-bars 63, which are preferably parallel to each other, that are disposed between opposed spaced side bars 65 and end opposed spaced end bars 67, the side and end bars 65 and 67 forming a rectangular frame. Each of the parallel bars 61, cross-bars 63, side bars 65 and end bars 67 are hollow elements, and the parallel bars 63 and 65 have an upper wall 69, lower wall 71 and outwardly extending side walls 73 extending from each of the upper and lower walls 69, 71 to meet at a connecting line 75. The grate members 59 are preferably blow molded and have hollow chambers 77 in the bars. Drainage openings 79 are provided in the grate members 59.

The grate members 59 are interchangeable in that a said grate member 59 may be placed on the tray 5 without any particular alignment as to whether the grate member is aligned relative to a side wall or an end wall of the tray on the surfaces 17 and 27. In the preferred embodiment where the tray is square in shape, a user may pick up and place a grate member 59 on the tray 5 without any determination as to any particular alignment of the grata member relative to side walls 11 or end walls 13. Also, since the grate members 59 are blow molded and have hollow parallel bars 61, crossbars 63, side bars 65 and end bars 67, the grate members use less material than solid grate members and are lighter in weight than solid members while still retaining strength to support drums.

In assembling the grate members 59 on the tray 5, the grate members 59 are of a size such that the ends 67 thereof will snap in and rest on either flange 15 or 25 and be secured under either inwardly directed lip 21 or 31 depending upon placement thereof on the tray. This secures the grate members in the tray and prevents unintentional dislodging of the grate members. The downwardly depending legs 23 and 33 are provided so as to allow engagement therewith of hold-down straps (not shown) for drums 3 that are placed on the spill skid.

With the present tray 5 with arms 49 of the center post 45 extending towards the corners of the tray, when a drum is placed on any of the f our quadrants of the tray, an arm 49 will be directly below the grate member 59 upon which the drum is resting and will provide direct support for the drum. Each grate member 59 rests upon a flange 15 of a side wall 11, portions of flanges 25 of opposed end walls 13 and two arms 49, or upon a flange 25 of an end wall 13, portions of flanges 15 of opposed side walls 11 and two arms 49, depending upon placement of the grate members 59 on the tray 5 by a user. Thus, five regions of support for each grate member 59 are assured regardless of the placement of the grate member on the tray 5, and at least three points of support are provided for drums placed on a grate regardless of which quadrant of a grate the drums are placed.

What is claimed is:

1. A hazardous material spill skid comprising:

a rectangular tray comprising a bottom wall, opposed side walls extending upwardly and outwardly from said bottom wall and opposed end walls extending upwardly and outwardly from said bottom wall, each said side wall and end wall terminating as a horizontally outwardly extending flange having an upper surface and a vertically upwardly extending rim;

a hollow center post extending upwardly from said bottom wall having a center portion and four arms, a said arm extending outwardly from the center of the bottom wall towards a corner connection between a said side wall and a said end wall, said center post having an upper surface in a horizontal plane substantially the same as a horizontal plane formed by said upper surface of said horizontally outwardly extending flanges;

a pair of interchangeable grate members, each said grate member resting on the horizontally outwardly extending flange of a said end wall, a portion of horizontally outwardly extending flanges of opposed side walls, and on two of said arms of the center post of said bottom wall, to provide a support surface for barrels placed on said grate member.

2. A hazardous material spill skid as defined in claim 1 wherein said tray has vertically extending recesses in each of the side walls and end walls extending from said bottom wall to a respective one of said horizontal outwardly extending flanges.

3. A hazardous material spill skid as defined in claim 1 wherein a plurality of first downwardly extending recesses are provided in said bottom wall adjacent the center of each of said side walls and end walls which form intermediate legs for said tray.

4. A hazardous material spill skid as defined in claim 3 wherein a plurality of second downwardly extending recesses are provided in said bottom wall at each corner of said tray which form corner legs for said tray.

5. A hazardous material spill skid as defined in claim 4 wherein each of said arms of said center post terminate adjacent a said second downwardly extending recess of said bottom wall of said tray.

6. A hazardous material spill skid as defined in claim 1 wherein central downwardly extending recesses are provided in said bottom wall at the intersection of adjacent arms of said center post to form four central support legs for said tray.

7. A hazardous material spill skid as defined in claim 1 wherein said vertically upwardly extending rim terminates in an inwardly directed lip and wherein ends of said grate members are secured on said flanges by said lip.

8. A hazardous material spill skid as defined in claim 1 wherein each said horizontally outwardly extending flange has a downwardly depending leg at the outer end thereof.

9. A hazardous material spill skid as defined in claim 1 wherein each said grate member comprises a blow molded unit having a plurality of bars interconnected by spaced cross-bars, each said bar and cross-bar being hollow.

10. A hazardous material spill skid as defined in claim 9 wherein said plurality of bars are parallel to each other, said plurality of cross-bars are parallel to each other, and said bars and cross-bars are disposed between hollow side and end bars forming a rectangular frame.

11. A hazardous material spill skid as defined in claim 10 wherein each of said parallel bars and cross-bars are hollow elements having an upper wall, lower wall, and outwardly extending side walls which meet at a connecting line.

12. A hazardous material spill skid comprising:

a rectangular tray comprising a bottom wall, opposed side walls extending upwardly and outwardly from said bottom wall and opposed end walls extending upwardly and outwardly from said bottom wall, each said side wall and end wall terminating as a horizontally outwardly extending flange having an upper surface and a vertically upwardly extending rim;

a hollow center post extending upwardly from said bottom wall having a center portion and four arms, a said arm extending outwardly from the center of the bottom wall towards a corner connection between a said side wall and a said end wall, said center post having an upper surface in a horizontal plane substantially the same as a horizontal plane formed by said upper surface of said horizontally outwardly extending flanges;

a pair of interchangeable grate members, each said grate member comprising a blow molded unit having a plurality of bars interconnected by spaced cross-bars with each said parallel bar and cross-bar being hollow, each said grate member resting on the horizontally outwardly extending flange of a said end wall, a portion of horizontally outwardly extending flanges of opposed side walls, and on two of said arms of the center post of said bottom wall, to provide a support surface for barrels placed on said grate member.

13. A hazardous material spill skid as defined in claim 12 wherein said plurality of bars are parallel to each other, said plurality of cross-bars are parallel to each other, and said bars and cross-bars are disposed between hollow side and end bars forming a rectangular frame.

14. A hazardous material spill skid as defined in claim 13 wherein each of said parallel bars and cross-bars, are hollow elements having an upper wall, lower wall, and outwardly extending side walls which meet at a connecting line.

15. A hazardous material spill skid as defined in claim 12 wherein a plurality of first downwardly extending recesses are provided in said bottom wall adjacent the center of each of said side walls and end walls which form intermediate legs f or said tray and a plurality of second downwardly extending recesses are provided in said bottom wall at each corner of said tray which form corner legs for said tray.

16. A hazardous material spill skid as defined in claim 15 wherein each of said arms of said center post terminate adjacent a said second downwardly extending recess of said bottom wall of said tray and central downwardly extending recesses are provided in said bottom wall at the intersection of adjacent arms of said center post to form four central support legs for said tray.

17. A hazardous material spill skid as defined in claim 12 wherein said tray has vertically extending recesses in each of the side walls and end walls extending from said bottom wall to a respective one of said horizontal outwardly extending flanges.

18. A hazardous material spill skid as defined in claim 12 wherein said vertically upwardly extending rim terminates in an inwardly directed lip and wherein ends of said grate members are secured on said flanges by said lip.

19. A hazardous material spill skid as defined in claim 12 wherein each said horizontally outwardly extending flange has a downwardly depending leg at the outer end thereof.

* * * * *